US005490482A

United States Patent [19]

Genet

[11] Patent Number: 5,490,482

[45] Date of Patent: Feb. 13, 1996

[54] TWO CYCLE ENGINE WITH PISTON MOUNTED POPPET VALVE OPERATING MECHANISM

[76] Inventor: William Genet, 2742 Frembes, Waterford, Mich. 48329

[21] Appl. No.: 201,373

[22] Filed: Feb. 24, 1994

[51] Int. Cl.[6] ..... F02B 75/02

[52] U.S. Cl. ..... 123/47 R; 123/47 AB; 123/65 VB

[58] Field of Search ..... 123/47 R, 47 AA, 123/47 AB, 65 VB, 65 V, 65 VC, 65 VD

[56] References Cited

U.S. PATENT DOCUMENTS

| | | | |
|---|---|---|---|
| 857,842 | 6/1907 | Stadel | 123/47 R |
| 1,010,754 | 12/1911 | Hall | 123/47 AA |
| 1,128,917 | 2/1915 | Tomasini | 123/65 VB |
| 1,580,720 | 4/1926 | Gold | 123/47 AA |
| 3,584,610 | 6/1971 | Porter | 123/47 R |
| 4,206,727 | 6/1980 | Siegien | 123/47 R |
| 4,218,994 | 8/1980 | Reed | 123/65 VB |
| 4,424,772 | 1/1984 | Porter | 13/65 VB |

FOREIGN PATENT DOCUMENTS

| | | | |
|---|---|---|---|
| 0064522 | 5/1977 | Japan | 123/47 R |

*Primary Examiner*—David A. Okonsky
*Attorney, Agent, or Firm*—John R. Benefiel

[57] ABSTRACT

A two cycle piston engine is described in which one or more intake poppet valves are carried in the top of the piston which driven onto a respective mating valve seat in the cylinder head by piston movement towards top dead center, a spring allowing retraction of the valve into the piston top after the poppet valve seats on its valve seat. A two valve arrangement opens one valve before the other, with air only in flowing through the first valve seat prior to opening of the other valve seat, through which fuel is injected.

9 Claims, 2 Drawing Sheets

TWO CYCLE ENGINE WITH PISTON MOUNTED POPPET VALVE OPERATING MECHANISM

BACKGROUND OF THE INVENTION

1. Field of the Invention

This invention concerns internal combustion engines and more particularly two cycle internal combustion piston engines.

2. Description of the Prior Art

Two cycle piston engines typically rely on cylinder wall porting to allow a fresh charge to be taken in and exhaust products to be exhausted. While simple, this allows intermixing of the fresh charge and a residual portion of the exhaust products from the previous firing cycle. Further, excessive amounts of unburned fuel passes out with the exhaust causing a high level of pollutants to be discharged into the atmosphere and reducing engine efficiency.

More sophisticated valving alleviates the problem, but this adds the cost of a cam shaft and valve operating components.

It is the object of the present invention to provide an arrangement for controlling intake and exhaust from the cylinder of a two cycle piston engine which minimizes exhaust pollution and maximizes engine efficiency while not requiring a complex valve operating mechanism.

SUMMARY OF THE INVENTION

This object is achieved by an improved valving arrangement featuring one or more poppet valves carried in the piston head driven closed against a valve seat or seats in the cylinder head by the movement of the piston towards top dead center.

The poppet valve is held extended out towards the valve seat by a valve spring, the valve stem driven back into the piston against the force of the valve spring after the valve head has made contact with the valve seat.

An exhaust port in the cylinder wall is located to allow exhaust of the combustion products as the piston approaches bottom dead center.

In a first embodiment, a sealed crankcase allows piston air injection, in which air is forced into the combustion chamber through the open poppet valve by descending movement of the piston. In this case, a scotch yoke driving connection is used to the engine crankshaft, the piston rod sealed to a bore through which it passes into the crankcase.

In a second embodiment, a root's type, positive displacement air compressor is used to inject air through a pair of piston mounted intake valves which are opened successively after the exhaust port is opened. The first opened valve allows inflow of a purging air from the compressor, the second carrying a fuel charge via directed port injection into the combustion chamber. Both intake valves are driven closed as the piston moves towards top dead center and past the exhaust port.

DETAILED DESCRIPTION

In the following detailed description, certain specific terminology will be employed for the sake of clarity and a particular embodiment described in accordance with the requirements of 35 U. S. C. 112, but it is to be understood that the same is not intended to be limiting and should not be so construed inasmuch as the invention is capable of taking many forms and variations within the scope of the appended claims.

Figure 1:
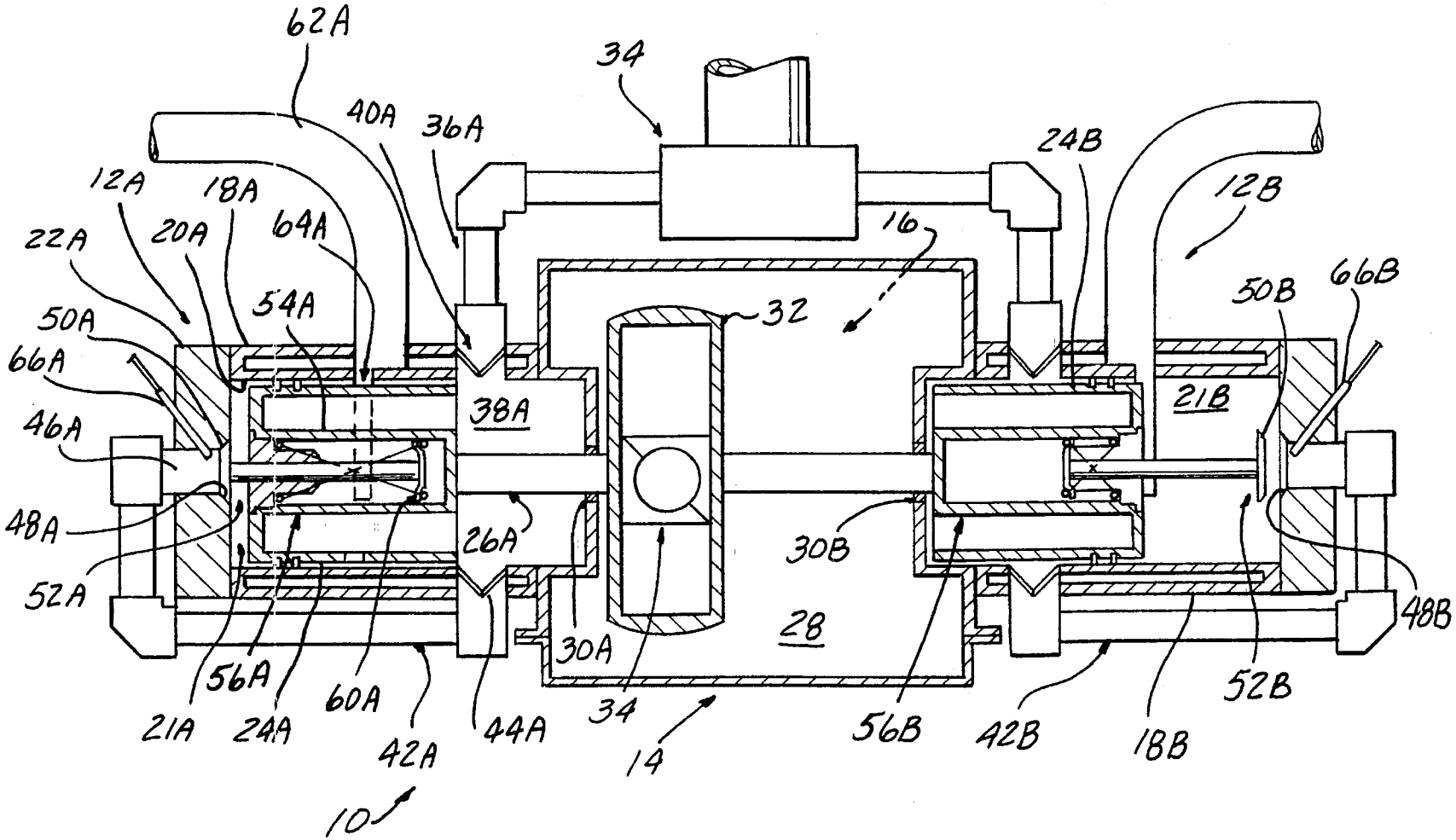
FIG. 1 is a diagrammatic representation of first embodiment of a two cycle internal combustion engine according to the invention.

Referring to FIG. 1, a two cycle piston engine 10 is depicted, which is shown as of an opposing two cylinder configuration, having a left cylinder 12A and a right cylinder 12B.

Each cylinder 12A, 12B is mounted to a common crankcase 14 housing a schematically represented crankshaft 16.

Each cylinder 12A, 12B includes a cylinder block 18A, 18B formed with a cylinder bore 20A, 20B closed off with a cylinder head 22A, 22B. A piston 24A, 24B is slidable in each cylinder bore 20A, 20B, suitable sealing rings provided as shown.

Each piston 24A, 24B has a piston connecting rod 26A, 26B fixed thereto which projects in a direction away from the cylinder head 22A, 22B and into the interior 28 of the crankcase 14.

The crankcase 14 is sealed, and piston connecting rod seals 30A, 30B are provided inasmuch as a lubrication system for the crankshaft 16 and connecting parts is contemplated for this embodiment.

A scotch yoke connection comprised of a slider housing 32 is fixed to the opposite end of each connecting rod 26A, 26B. A slider 34 is pinned to the crankshaft 16 such that reciprocation of the connecting rods 26A, 26B is converted into rotation of crankshaft 16 in the well known manner.

An air intake manifold 34 includes branch ducts 36A, 36B communicating with the space 38A, 38B within each cylinder block 18A, 18B beneath the respective piston 24A, 24B via one way inlet flap valves 40A, 40B.

Branch ducts 42A, 42B receive air forced out of the space 38A, 38B via one way flap valves 44A, 44B. Branch ducts 42A, 42B lead to an inlet port 46A, 46B in the respective cylinder head 22A, 22B entering into the cylinder bore 20A, 20B in the combustion chamber space 21A, 21B above the piston 24A, 24B.

A valve seat 48A, 48B is formed about each port 46A, 46B configured to sealingly be engaged with a poppet valve head 50A, 50B of a poppet valve 52A, 52B. Each poppet valve 52A, 52B has a valve stem 54A, 54B integral with the valve head 50A, 50B and slidably received into the top of a respective piston 24A, 24B.

A cylindrical receiver 56A, 56B receives the valve stem 54A, 54B, which is urged outwardly by a spring 58A, 58B acting on a retainer plate 60A, 60B fixed to the end of valve stem 54A, 54B.

An exhaust pipe 62A, 62B is connected to a slotted exhaust port 64A, 64B entering each cylinder bore 20A, 20B at an intermediate level.

When each piston 24A, 24B is in a position approaching BDC, the poppet valve head 50A, 50B is unseated to open the valve seat 48A, 48B. In this condition, the poppet valve 52A, 52B projects well forward of the top of its associated piston 24A, 24B which is the illustrated position of the right poppet valve 52B in FIG. 1.

As each piston 24A, 24B moves towards BDC, it causes a volume of air in chamber 38A, 38B previously drawn in through flap valve 40A to be expelled out through flap valve 44A, 44B through ducts 42A, 42B and into the chamber 21A, 21B. An additional opening 43A, 43B in each piston 24A, 24B allows air into chamber 38A, 38B to flow out as the piston 24A, 24B approaches BDC.

A direct port injector injects a fuel charge after the piston 24A, 24B moves towards TDC past the exhaust port 64A, 64B. After the poppet valve head 50A, 50B has against been moved onto valve seat 48A, 48B, compression begins and ignition by a spark plug (not shown) initiates combustion.

As the piston 24A, 24B moves towards BDC, the exhaust port 64A, 64B is again opened, allowing the products of combustion to flow out.

The intake ports 46A, 46B are located in the cylinder head 22A, 22B so as to minimize the outflow of unburned injected fuel, but allow good scavenging by cross flow. At the same time, the intake valves 52A, 52B are driven closed to insure good sealing but without the need for a cam shaft and associated valve operating mechanisms.

Valve timing can be precisely set by suitable shimming of the valves 50A, 50B.

Figure 2:
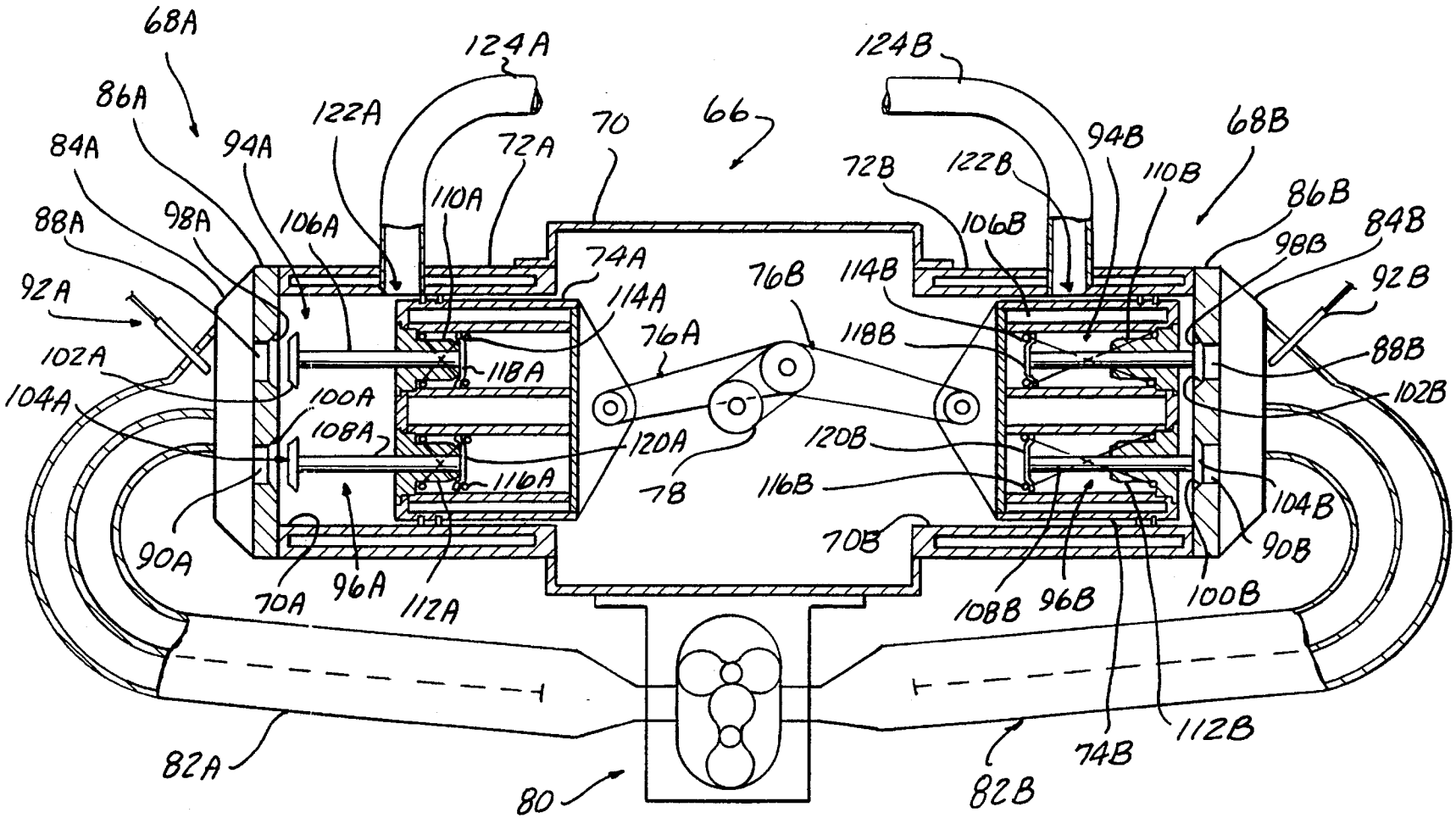
FIG. 2 is a diagrammatic representation of a second embodiment of a two cycle internal combustion engine according to the invention.

FIG. 2 shows an alternate embodiment of an internal combustion engine 66, which also is illustrated as an configured with two cylinders 68A, 68B.

In this embodiment, the crankcase 70 is open to the cylinder bores 70A, 70B formed in cylinder blocks 72A, 72B attached to the crankcase 70.

Pistons 74A, 74B slidably disposed in respective bores 70A, 70B have connecting rods 76A, 76B driving crankshaft 78.

A blower 80 directs air through respective dual ducts 82A, 82B to an intake manifold 84A, 84B.

Cylinder heads 86A, 86B each have a pair of intake ports 88A, 88B and 90A, 90B formed therein, which receive air flow from the associated manifold 84A, 84B.

A directed port fuel injector 92A, 92B is located to direct an injection of fuel into port 88A, 88B.

In this embodiment, two intake poppet valves 94A, 94B and 96A, 96B are mounted projecting from the top of each piston 74A, 74B, each having a valve head 102A, 102B, 104A, 104B aligned with a respective valve seat 98A, 98B and 100A, 100B machined about a respective intake port 88A, 88B and 90A, 90B.

Each intake poppet valve 94A, 94B and 96A, 96B includes a valve stem 106A, 106B and 108A, 108B, slidably received in a respective one of a pair of valve guides 110A, 110B, and 112A, 112B fixed in the top of each piston 74A, 74B.

A tension spring 114A, 114B and 116A, 116B acting through a respective retainer 118A, 118B and 120A, 120B urges an engaged valve stem 106A, 106B and 108A, 108B so that the poppet valves 94A, 94B and 96A, 96B project forwardly of the top of the mounting piston 74A, 74B as shown with respect to piston 74A in FIG. 2, but can be pushed back into the mounting piston 74A, 74B when the mounting piston 74A, 74B advances towards TDC to bring the valve heads 102A, 102B and 104A, 104B into engagement with its respective valve seat 98A, 98B and 100A, 100B as shown with piston 74B in FIG. 2.

An exhaust port 122A, 122B is formed in the wall of each cylinder bore 70A, 70B with an exhaust pipe 124A, 124B receiving outflow from each.

Each pair of intake poppet valves 94A, 96A and 94B and 96B are arranged to open at slightly staggered times after the exhaust port is uncovered. The poppet valves 96A, 96B associated with intake ports 90A, 90B which receive only air flow are opened first, a few degrees before opening of valves 94A, 94B associated with intake ports 88A, 88B which also receive fuel with air. This lessens the extent to which unburned fuel escapes out the exhaust ports 122A, 122B.

Precise setting of the valve timing can be achieved by shimming of the intake poppet valves 94A, 96A, 94B, 96B.

Thus, head located poppet valves are used to separate the intake and exhaust, without including cam shaft and valve operating mechanism, providing an improved two cycle piston engine.

I claim:

1. A two cycle internal combustion piston engine comprising:

a cylinder block defining a cylinder bore;

a cylinder head closing off said cylinder bore;

a piston slidable in said cylinder bore having a top portion defining, together with said cylinder bore and said cylinder head, a combustion chamber;

a crankshaft and means rotating said crankshaft by reciprocation of said piston in said cylinder bore;

an exhaust port in said cylinder bore opened by movement of said piston towards bottom dead center;

an intake port in said cylinder head allowing inflow of air into said combustion chamber;

fuel injection means directing a fuel charge into said combustion chamber during each engine intake cycle; and a poppet valve including a valve head and a valve stem, said valve stem slidably mounted in said piston top and spring means carried by said piston urging said poppet valve outward so that said valve head projects outwardly from said piston top and into said combustion chamber;

a valve seat associated with said air intake port and aligned with said poppet valve head so that said poppet valve head is driven to seat onto said valve seat as said piston moves towards top dead center; said spring means overcome by continued movement of said piston towards top dead center to slide said poppet valve stem back into said piston.

2. The two cycle piston engine according to claim 1 further including air supply means for causing an inflow through said air intake port upon opening of said poppet intake valve by continued movement of said piston towards bottom dead center.

3. The two cycle piston engine according to claim 2 wherein said air supply means includes a sealed space below said piston, air duct means directing air flow caused by movement of said piston from said sealed space to said air intake port, and flap valve means allowing only air inflow to said sealed space upon movement of said piston out of said sealed space and towards top dead center and only outflow to said air duct means upon movement of said piston into said sealed space and towards bottom dead center.

4. The two cycle piston engine according to claim 3 wherein said means connecting said piston rod and said crankshaft comprises a scotch yoke mechanism, said crankshaft and said scotch yoke mechanism mounted in a crankcase, said piston rod projecting into said crankcase to be engaged by said scotch yoke mechanism and reciprocate the same, and an oilseal sealing about said piston rod where said piston rod passes into said crankcase.

5. The two cycle piston engine according to claim 2 wherein said air supply means comprises a positive displacement blower directing a flow of air into said air intake port when said poppet valve moves off said valve seat.

6. The two cycle piston engine according to claim 5 further including a second air intake port in said cylinder head and a second poppet valve carried by said piston, a second valve seat formed around said air intake port, said second poppet valve having a valve head and a valve stem, said valve head of said second poppet valve aligned with said second valve seat so as to be seated thereunto upon continued movement of said piston towards top dead center, said second poppet valve stem slidably received in said piston so as to project towards said second valve seat from the top of said piston, and spring means urging said second poppet valve outwardly from said top of said piston, but allowing movement of said valve stem into said top of said piston after said second poppet valve head seats on said second valve seat.

7. The two cycle piston engine according to claim 6 wherein said second poppet valve head moves off said second valve seat slightly before said first mentioned poppet valve head moves off said first mentioned valve seat as said piston moves towards bottom dead center.

8. The two cycle piston engine according to claim 7 wherein said fuel injector means directs fuel only into said first mentioned air intake port, whereby only air inflow begins through said second air intake port.

9. The two cycle piston engine according to claim 8 wherein said fuel injection means comprises a direct port injector.

* * * * *